United States Patent [19]

Jacobs, Jr.

[11] 4,272,752

[45] Jun. 9, 1981

[54] ELECTRIC FUSE INCLUDING TWO DIFFERENT FILLERS

[75] Inventor: Philip C. Jacobs, Jr., Newtonville, Mass.

[73] Assignee: Gould Inc., Rolling Meadows, Ill.

[21] Appl. No.: 62,078

[22] Filed: Jul. 30, 1979

[51] Int. Cl.[3] ..... H01H 85/18

[52] U.S. Cl. ..... 337/276; 29/623; 337/273

[58] Field of Search ..... 337/273, 274, 275, 276, 337/277, 278, 279, 280, 281, 282; 338/238, 239, 240, 241, 242; 29/614, 623

[56] References Cited

U.S. PATENT DOCUMENTS

| | | | |
|---|---|---|---|
| 1,992,787 | 2/1935 | Sutton | 338/238 |
| 2,139,785 | 12/1938 | Wiegand | 338/241 |
| 2,899,663 | 8/1959 | Ross | 338/238 |
| 3,291,942 | 12/1966 | Kozacka | 337/276 |
| 3,818,409 | 6/1974 | Pastors et al. | 337/277 |
| 4,091,353 | 5/1978 | Fisk et al. | 337/273 |

FOREIGN PATENT DOCUMENTS

| | | | |
|---|---|---|---|
| 494023 | 6/1953 | Canada | 29/614 |

*Primary Examiner*—Harold Broome
*Attorney, Agent, or Firm*—Erwin Salzer

[57] ABSTRACT

A dual element fusible device is provided utilizing a plurality of separate arc quenching fillers disposed in layers within the fuse casing and being effectively separated from one another by an electrically insulative material which is introduced into the casing in a fluid state so that regardless of the configuration of the internal workings of the fuse, it establishes a continuous and impermeable barrier between the respective layers.

6 Claims, 7 Drawing Figures

ELECTRIC FUSE INCLUDING TWO DIFFERENT FILLERS

BACKGROUND OF THE INVENTION

Mixtures of arc quenching materials have been used in dual element type electric fuses to provide and couple optimum arc quenching performance with the respective overload or short circuit regions of the particular fusible element.

Two basic approaches have been applied in the past. Either the arc quenching materials are homogenously mixed as disclosed in U.S. Pat. Nos. 3,227,844 by Burrage et al for: Fuse With Hydrated Arc Extinguishing Material, issued Jan. 4, 1966; 3,197,592 by Kozacka for: Time Lag Fuses With Fuse Links Having Link-Severing Overlays, issued July 27, 1965; 4,074,220 by Santilli for: Fuse Structure Having Improved Granular Filler Material, issued Feb. 14, 1978, which combines the arc quenching action, as contributed by the different materials, to the entire fusible element, or the arc quenching materials are arranged in layers or strata as disclosed in U.S. Pat. Nos. 1,140,953 by R. C. Cole for: Electric Safety Fuse, issued May 25, 1915; 2,500,808 by H. V. Dryer for: Fuse Construction, issued Mar. 14, 1950; 2,551,830 by H. V. Dryer for: Fuse Construction, issued May 8, 1951, with a particular material situated adjacent that portion of the fusible element which requires the specific arc quenching action provided by that particular material. It is the latter type with which the present invention is concerned.

Heretofore, the different filler layers have been poured one on top of the other with no physical means of separation. Fuses of this type are subject to considerable intermixing of the respective layers due to vibration and differences in specific gravities and particle sizes between the materials, often leading to fuse failure. This problem was later solved by inserting a physical barrier, such as a washer of electrical insulation, between adjoining layers, a solution which has proven costly and in fact impractical with multiple fusible elements or with elements of other than planar configuration.

It is accordingly, a general object of the present invention to provide electric fuses with a plurality of fillers each distinctly separated by means easily introduced and universally applicable being entirely independent of fusible element geometry.

Another object of the present invention is to provide a fuse having multiple filler construction, which construction is cost effective and lends itself particularly well to automation.

Further objects and advantages will readily become apparent as this specification proceeds.

SUMMARY OF THE INVENTION

A dual element fuse is provided with a plurality of distinct filler layers embedding the fusible element. Each layer is effectively sealed from the adjacent layer by a thin electrically insulative barrier established by introducing an electrically insulative material which is in a fluid state onto each filler layer following their respective addition to the fuse. The insulative material acts either directly on the filler by permeating and subsequently solidifying or caking the material into a concretious barrier or it may be of a self hardening nature which settles on the surface of the filler and hardens to form a barrier, or the action may be a combination of both.

DESCRIPTION OF THE PREFERRED EMBODIMENT

Figure 1:
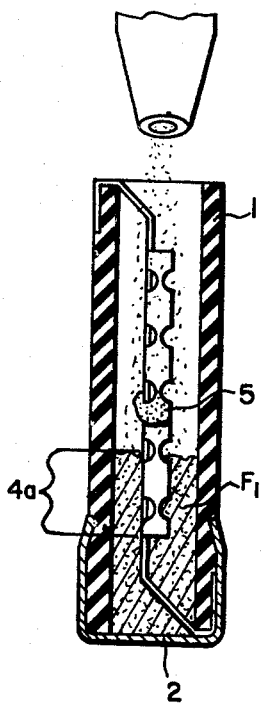
FIGS. 1–5 are longitudinal sections partly in elevation which sequentially show the filling of fuses incorporating the present invention.

Referring now to the drawings and more particularly to the FIGS. 1–5 thereof, what is shown is an electric fuse in the process of being manufactured with multiple layers of differing filler material and utilizing the separatory means of the present invention between the layers. Numeral 1 refers to a casing of electric insulation which is ultimately closed on both ends by terminal members 2. Fusible element 4 is centrally located within casing 1 and conductively interconnects terminals 2. Fusible elements designed for use with the present invention are of the dual element type which provide two different fusing characteristics in series per fusible element enabling a fuse to be responsive to both overload currents and short circuit currents while remaining within the specified time/current parameters for that particular fuse.

Figure 2:
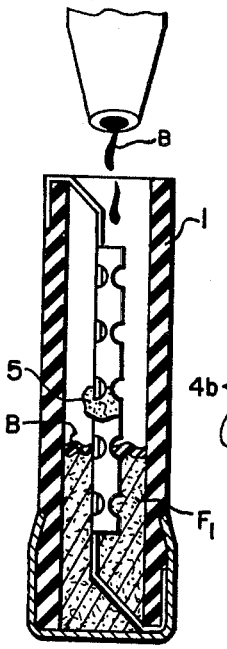
Figure 3:
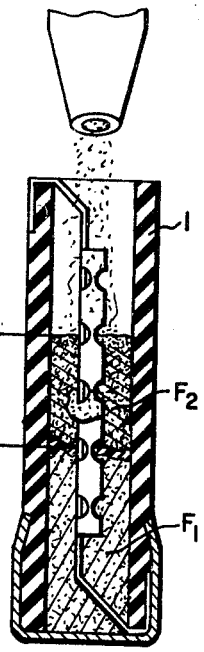
Figure 6:
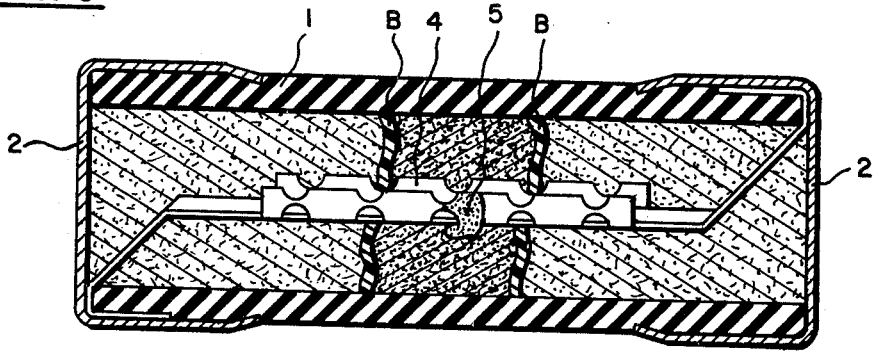
FIG. 6 is a longitudinal section partly in elevation of the completed fuse of FIGS. 1–5 on a larger scale.
Figure 7:
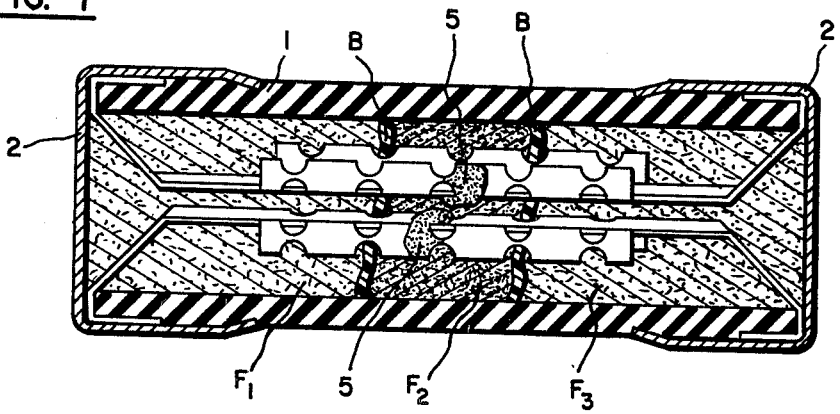
FIG. 7 is a longitudinal section partly in elevation of a fuse with multiple elements incorporating the present invention.

In the illustrated embodiment, the fusible element 4, generally made of Cu or Ag, utilizes an overlay of a low melting point metal such as tin 5 to achieve the low current interrupting characteristics, as more clearly shown in FIGS. 6 and 7. This overlay is generally applied midway along the axis of the fusing portion of said fusible element, and melts at a relatively low temperature establishing a point of high resistance, due to diffusion into and alloying with the base metal, with consequent melting thereof at a lower temperature than the actual melting temperature of the base metal. We have found that in dual element fuses of this type, different filler materials are sometimes necessary for the different fusing portions of the fusible element to thereby effectively quench the arcs resulting from fusion thereof. For example, materials which evolve cooling gases under the influence of heat have been found to be particularly suited for arcing resulting from overload conditions, whereas materials capable of absorbing large quantities of heat and which do not evolve gases are desirably used under short circuit conditions. It is therefore of prime importance, in multiple filler fuses of this type, to insure the integrity of the respective layers. FIG. 1 shows the first step in filling fuses of this type. Following terminal assembly on one end of casing 1, a first filler material $F_1$ is added to a depth sufficient to embed a first short circuit interrupting section 4*a* of element 4, but leaving overload section 4*b* uncovered. In FIG. 2, an electrically insulative material B in a fluid state is introduced in sufficient quantity to cover the entire surface of filler $F_1$. The fluidity of material B enables it to freely flow around the fusible element regardless of its configuration, conforming to the surface which it contacts, and to thereafter effectively seal the same. Material B may be an epoxy which once applied, subsequently hardens forming an impermeable barrier, or it may be a material such as sodium silicate, i.e. water glass, which gels and maintains a high enough viscosity so as to be effectively impermeable, or it may be ordinary water which, contingent on the water absorbtive properties of the filler, mixes with the top stratum of the filler forming a mud, and subsequently dries leaving an impervious cake which serves as the barrier. The 2nd filler $F_2$ is then added in FIG. 3, embedding the overload section 4*b* of element 4 and extending axially both directions a short distance therefrom.

Figure 4:
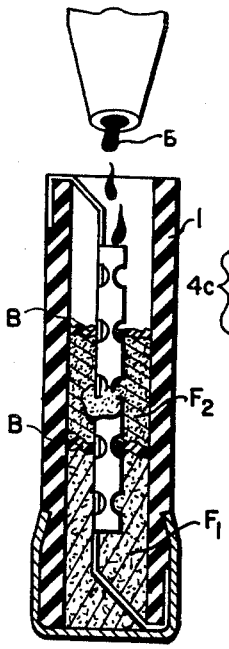
Figure 5:
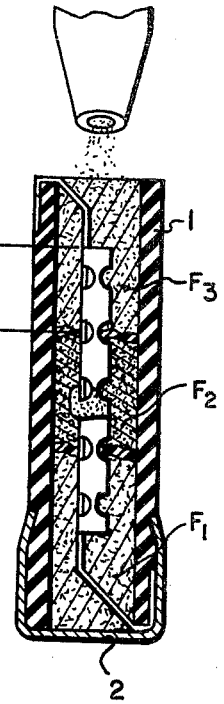

Again in FIG. 4, electrically insulative material B is introduced to form a seal over filler $F_2$. In FIG. 5 the last filler layer $F_3$, which may or may not be the same as that used in the initial filling operation, is added embedding the second short circuit portion 4*c*. FIG. 6 shows the completed fuse with the second terminal cap 2 installed. The completed fuse incorporates separate filler materials distinctly separated into strata in which are embedded the respective portions of the dual purpose element with which they were designed to cooperate for optimum arc quenching performance.

FIG. 7 is illustrative of the universality of this means of separation between fillers. Two fusible elements of non planar configuration are shown embedded by different fillers which are effectively and uniformly separated by the barrier means of the present invention.

I claim as my invention:

1. An electric fuse comprising:

(a) a casing of electric insulating material, (b) terminal caps disposed on the ends of the casing, (c) fusible element means arranged inside said casing and electrically interconnecting said terminal elements, (d) a plurality of differing arc quenching materials arranged in layers within said casing and embedding said fusible element means, and (e) electrically insulative barrier means introduced in a fluid state between said layers so as to conform to the geometry of said fusible element means and to the surface of said layers and thereby establish an essentially impermeable barrier between said layers.

2. An electric fuse as specified in claim 1 wherein said fusible element has in series two different regions evidencing two different fusing characteristics.

3. An electric fuse as specified in claim 2 wherein said two different fusing characteristic regions are respectively embedded by two different arc quenching fillers which produce optimum arc quenching action specific to the fusing characteristic for the region with which it is in contact.

4. An electric fuse as specified in claim 1 wherein said electrically insulative barrier means is water.

5. An electric fuse as specified in claim 1 wherein said electrically insulative barrier means is water glass (sodium silicate).

6. An electric fuse as specified in claim 1 wherein said electrically insulative barrier means is an epoxy.

* * * * *